US009205440B2

(12) United States Patent
Bae

(10) Patent No.: US 9,205,440 B2
(45) Date of Patent: Dec. 8, 2015

(54) DISPENSER FOR SUCKING BACK CONTENTS

(71) Applicant: YONWOO CO., LTD., Incheon (KR)

(72) Inventor: Young-Moo Bae, Incheon (KR)

(73) Assignee: YONWOO CO., LTD., Incheon (KR)

( * ) Notice: Subject to any disclaimer, the term of this patent is extended or adjusted under 35 U.S.C. 154(b) by 81 days.

(21) Appl. No.: 14/060,003

(22) Filed: Oct. 22, 2013

(65) Prior Publication Data

US 2015/0108172 A1 Apr. 23, 2015

(51) Int. Cl.
*B05B 11/00* (2006.01)

(52) U.S. Cl.
CPC ..... *B05B 11/3097* (2013.01); *B05B 11/3001* (2013.01); *B05B 11/3069* (2013.01); *B05B 11/3076* (2013.01)

(58) Field of Classification Search
CPC ..... B05B 11/3001; B05B 11/3077; B05B 11/3076; B05B 11/3097; B05B 11/3069
USPC ..... 222/321.3, 321.7, 321.9, 341, 571
See application file for complete search history.

(56) References Cited

U.S. PATENT DOCUMENTS

| | | | | |
|---|---|---|---|---|
| 4,147,476 | A * | 4/1979 | Warren | 417/328 |
| 5,638,996 | A * | 6/1997 | Montaner et al. | 222/321.2 |
| 5,924,604 | A * | 7/1999 | Shimada et al. | 222/321.9 |
| 7,410,079 | B2 * | 8/2008 | Kuwahara et al. | 222/321.2 |
| 8,672,190 | B1 * | 3/2014 | Wang | 222/153.13 |

* cited by examiner

*Primary Examiner* — Frederick C Nicolas
(74) *Attorney, Agent, or Firm* — Marshall, Gerstein & Borun LLP

(57) ABSTRACT

The Dispenser for sucking back contents is provided, which makes it possible to prevent over consumption of contents in such a way to suck back the contents remaining at an end portion of a nozzle of a button of a dispenser after the contents are discharged and used, and also makes it possible to prevent a container body from being contaminated by contents.

1 Claim, 6 Drawing Sheets

DISPENSER FOR SUCKING BACK CONTENTS

BACKGROUND

The present invention relates to a dispenser for sucking back contents, and more particularly to a dispenser for sucking back contents which makes it possible to prevent over consumption of contents in such a way to suck back the contents remaining at an end portion of a nozzle of a button of a dispenser after the contents are discharged and used, and also makes it possible to prevent a container body from being contaminated by contents.

Common liquid or sticky liquid type cosmetic is stored in a dispenser container and is used as it is discharged by a certain amount. The dispenser container is equipped with a dispenser at the top of a container which stores contents. The above dispenser is pumped when a button with a nozzle is pressed for thereby discharging contents from the dispenser container.

In case of the above mentioned dispenser, when a user presses the button so as to discharge contents, the contents remains at an end portion of the nozzle after the contents is discharged. In this event, the contents remaining at the end portion of the nozzle may move down and contaminate the container and may be spoiled as it directly contact with air. In worse case, the contents may be hardened and block the nozzle. When such situation occurs, the user first needs to remove the hardened and stuck contents when in use. The contents may be over consumed.

Under the above described problems in the conventional art, many researchers are strongly interested in developing various dispensers which are capable of sucking back the contents remaining at the end portion of the nozzle in an attempt to prevent the container from being contaminated.

SUMMARY OF THE INVENTION

Accordingly, it is an object of the present invention to provide a dispenser for sucking back contents which makes it possible to prevent over consumption of contents in such a way to suck back the contents remaining at an end portion of a nozzle of a button of a dispenser after the contents are discharged and used, and also makes it possible to prevent a container body from being contaminated by contents.

To achieve the above objects, there is provided a dispenser for sucking back contents, comprising a body which is engaged to the top of a container body; an engaging body which is engaged to the body and fixes a cylinder and is hollow; a cylinder which is engaged to the bottom of the engaging body and has a content input hole formed at the bottom for inputting contents and a valve member which is opened and closed by the pressure of contents in the content input hole; a stem which passes through the hollow interior of the engaging body and has a support shoulder at an inner surface; a piston rod which is engaged to the stem, the bottom of which piston rod is equipped with a spring support part, and the top of which has a spring engaging protrusion which protrudes in an upward direction; a sealing cap which is installed at the bottom of the stem, the outer surface of the sealing cap coming into close contact with an inner surface of the cylinder; a first spring which is installed in the interior of the cylinder and serves to provide an elastic force to the piston rod; a second spring which is installed surrounding the spring engaging protrusion of the piston rod, the bottom of which second spring is supported by the piston rod, and the top of which is supported by the support shoulder of the stem for thereby providing an elastic force in an upward direction; and a button which is engaged to the top of the stem and has a nozzle for discharging contents.

In addition, the second spring is contracted by a support shoulder when the stem descends and recovers for thereby allowing the stem to ascend, so the contents remaining at an end portion of the nozzle is sucked back as much as the distance defined as the support shoulder of the stem and the spring engaging protrusion of the piston rod are spaced apart.

In addition, the sealing cap is made from an elastic material and is contracted by a pressure of the stem when the stem descends and recovers, so the stem is allowed to ascend by a change of the length of the sealing cap, for thereby sucking back the contents remaining at an end portion of the nozzle.

The present invention is advantageous because it is possible to prevent over consumption of contents in such a way to suck back the contents remaining at an end portion of a nozzle of a button of a dispenser after the contents are discharged and used, and also makes it possible to prevent a container body from being contaminated by contents.

DETAILED DESCRIPTION OF THE INVENTION

The preferred embodiments of the present invention will be described with reference to the accompanying drawings.

Figure 1:
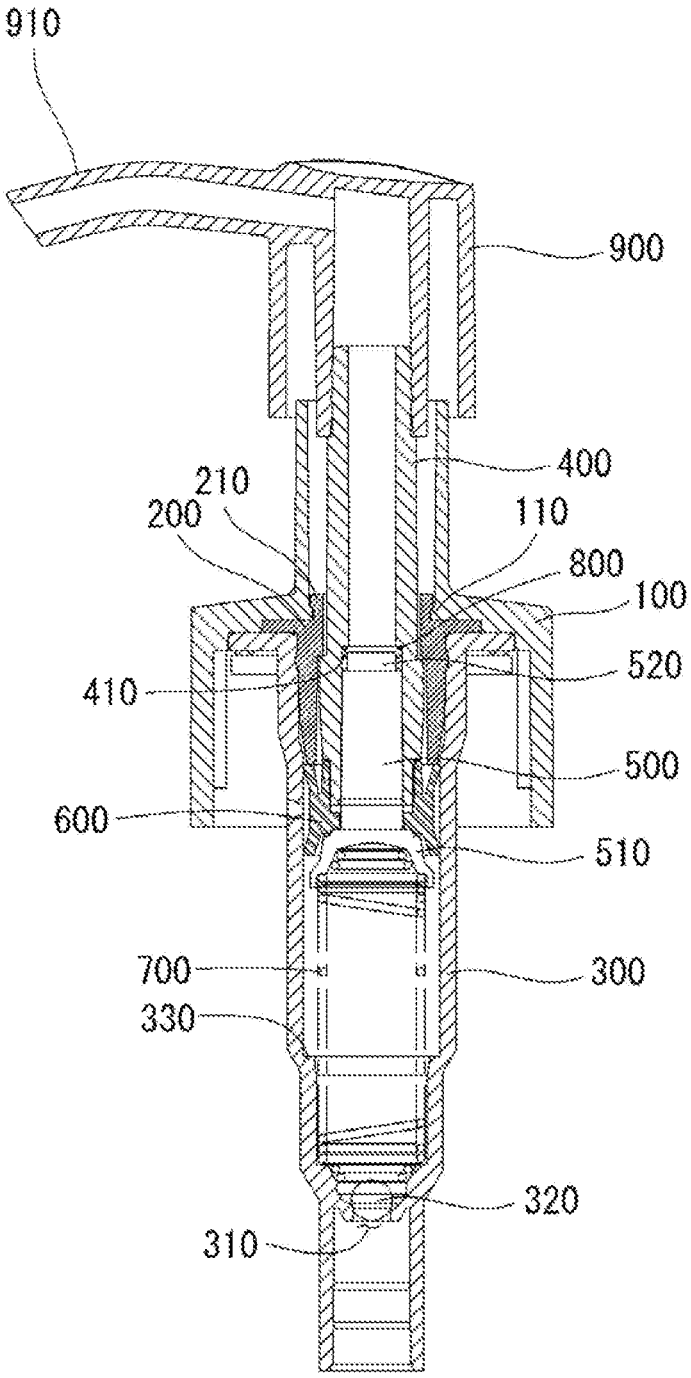
FIG. 1 is a cross sectional view illustrating a construction of a dispenser for sucking back contents according to a preferred embodiment of the present invention.
Figure 2:
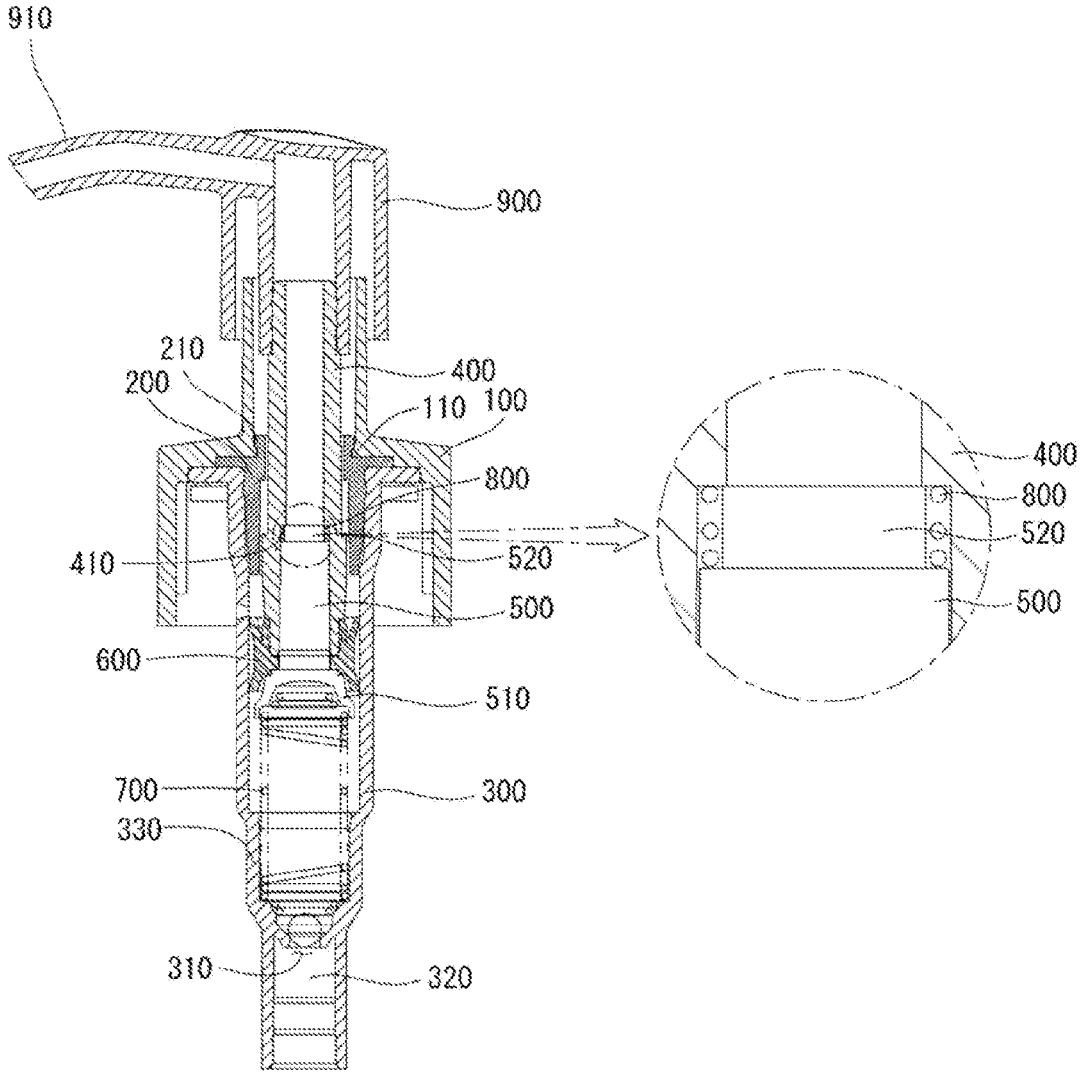
FIGS. 2 to 5 are views for explaining a suck-back procedure of contents of a dispenser for sucking back contents according to a preferred embodiment of the present invention.
Figure 3:
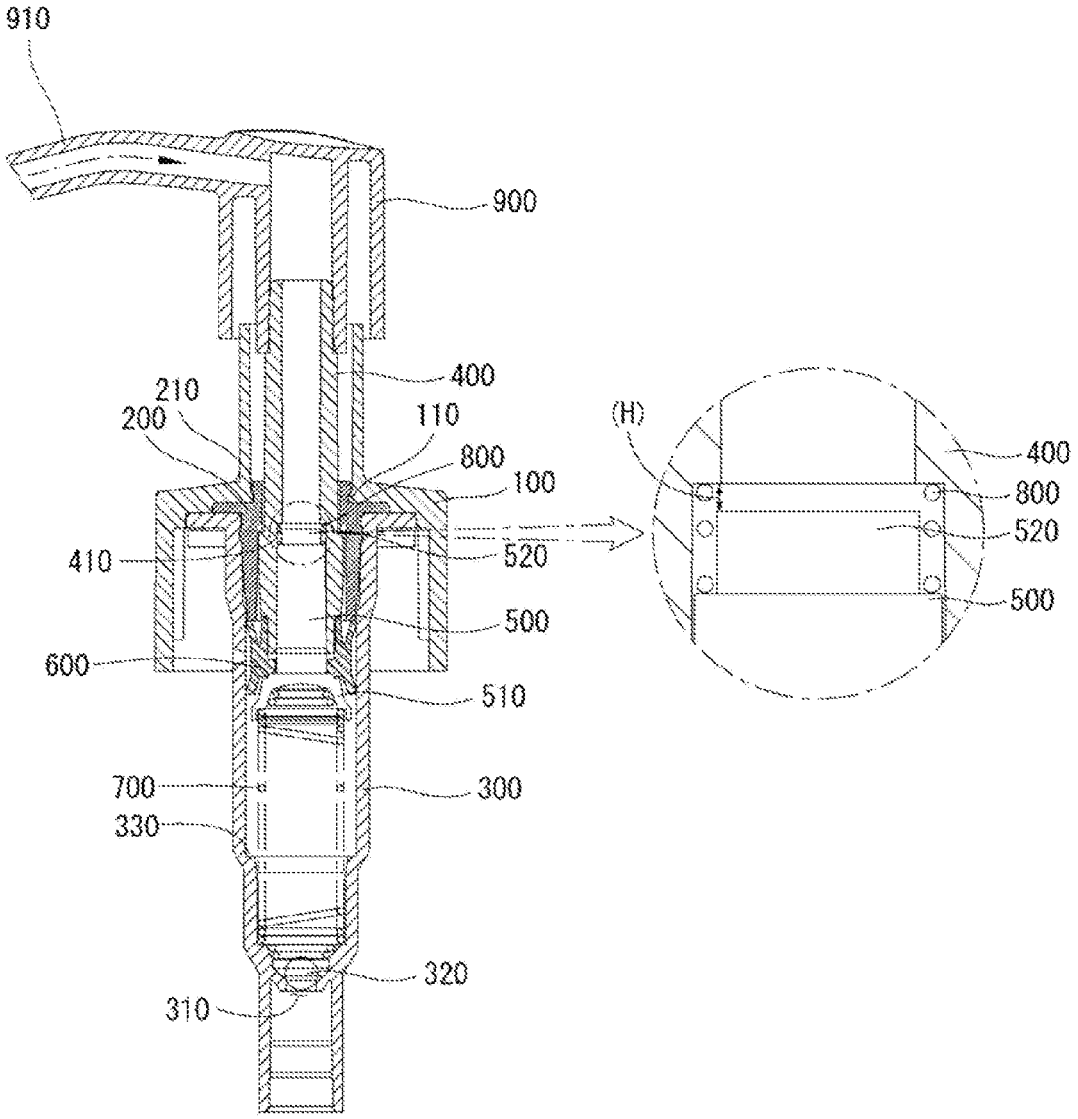
Figure 4:
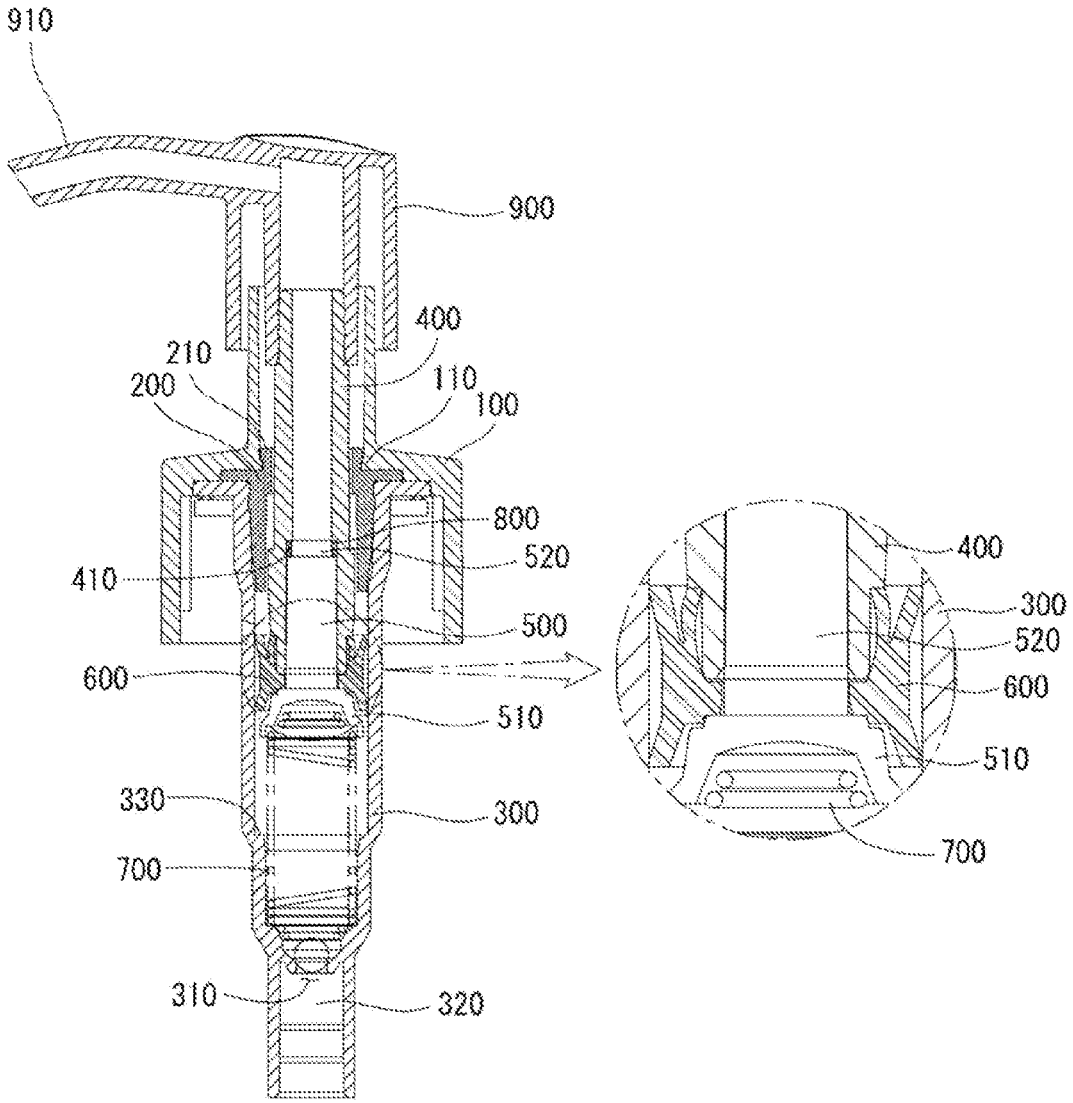
Figure 5:
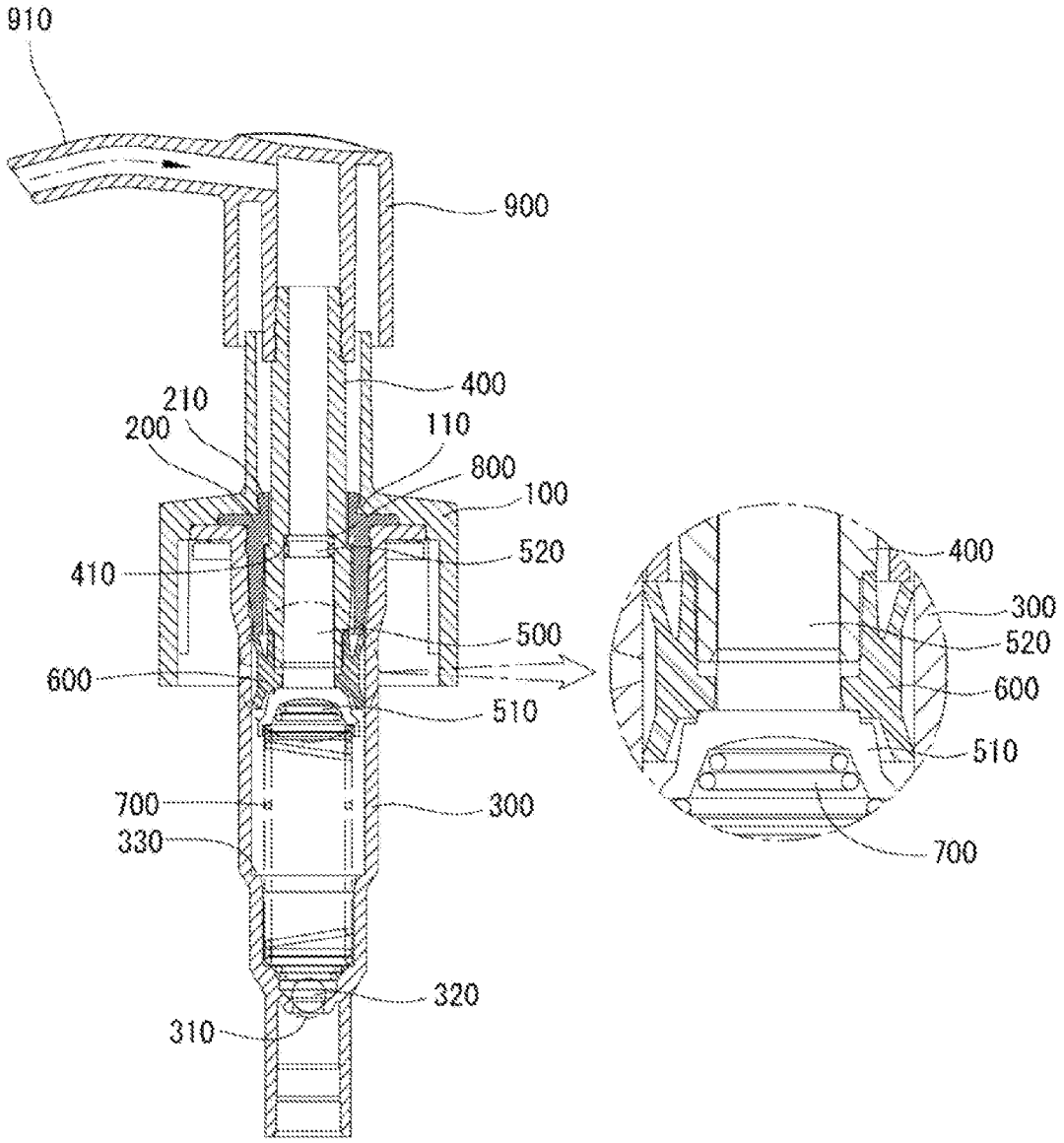
Figure 6:
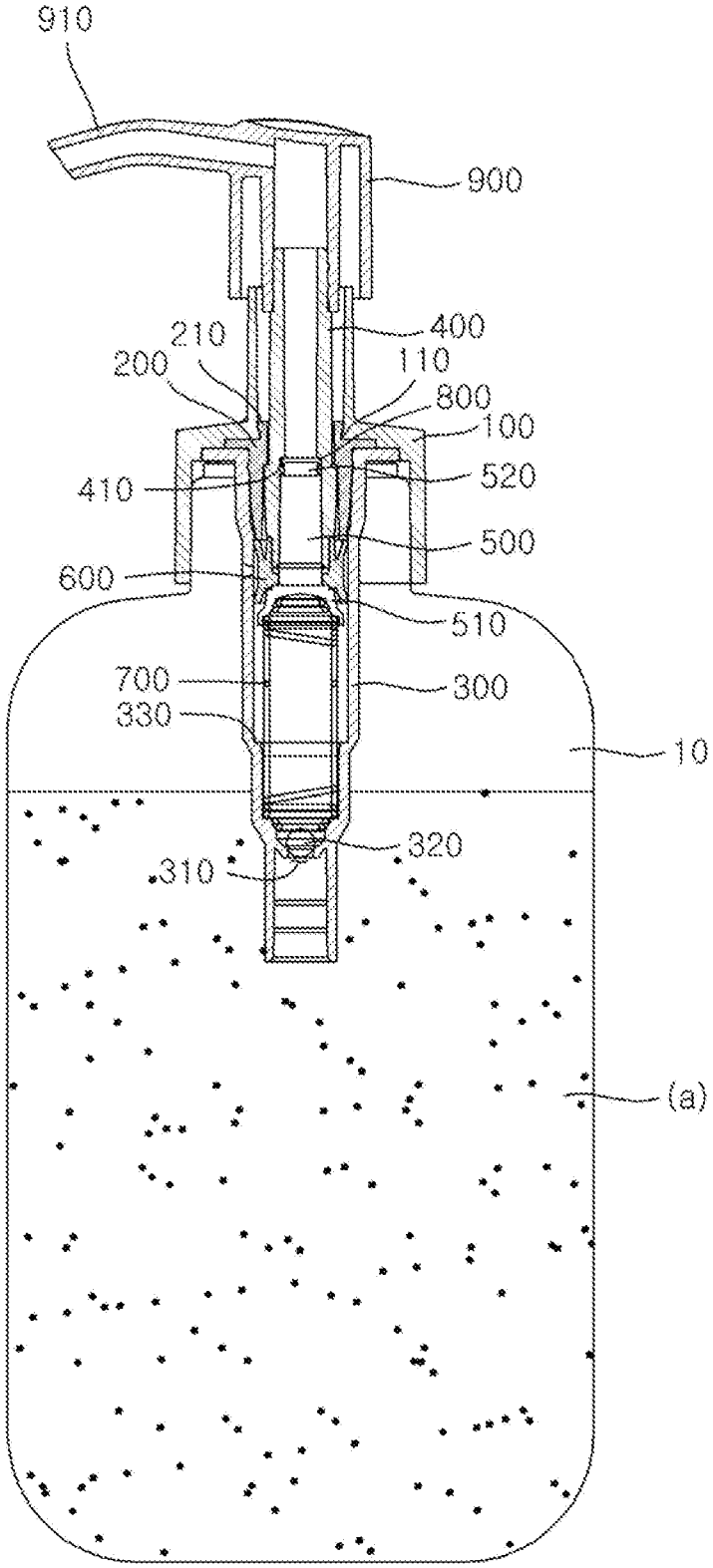
FIG. 6 is a cross sectional view illustrating a state that a dispenser for sucking back contents is engaged to a container body according to a preferred embodiment of the present invention.

FIG. 1 is a cross sectional view illustrating a construction of a dispenser for sucking back contents according to a preferred embodiment of the present invention. FIGS. 2 to 5 are views for explaining a suck-back procedure of contents of a dispenser for sucking back contents according to a preferred embodiment of the present invention. FIG. 6 is a cross sectional view illustrating a state that a dispenser for sucking back contents is engaged to a container body according to a preferred embodiment of the present invention.

As best seen in FIGS. 1 to 6, the dispenser for sucking back contents according to the present invention comprises a body 100, an engaging body 200, a cylinder 300, a stem 400, a piston rod 500, a sealing cap 600, a first spring 700, a second spring 800 and a button 900.

The body 100 is engaged to the top of the container body 10 which is filled with contents "a" for thereby closing the open top of the container body 10, and the body 100 has an engaging shoulder 110 at its inner side for an engagement to the engaging body 200.

The engaging body 200 is engaged to the body 100 for thereby fixing the cylinder 300 and has an engaging protrusion 210 at its portion which comes into contact with the engaging shoulder 110, for the engaging protrusion 210 to be fixedly mounted at the engaging shoulder 110 of the body 100.

The engaging body 200 is formed in a hollow shape for the stem 400 to pass through.

The cylinder 300 is engaged to the bottom of the engaging body 200 and has a content input hole 310 at its lower side for the content stored in the container body 100 to input. It is preferred that a valve member 320 is installed at the content input hole 310 for the purpose of preventing a reverse flow of contents as it is opened and closed by the pressure of the contents.

The stem 400 passes through the hollow portion of the engaging body 200 and is formed in a cylindrical shape the top and bottom of which communicate with each other for the contents to pass through. In the present invention, at an inner surface of the stem 400 is provided a support shoulder 410 supporting the top of the second spring 800. When the stem 400 descends by the pressure of the button 900, the second spring 800 pressurizes the second spring 800 and moves down and comes into contact with the top of the spring engaging protrusion 520 of the piston rod 500 for hereby transferring a pressure to the piston rod 500, so the piston rod 500 moves downward.

The piston rod 500 is inserted into the bottom of the stem 400. A certain space is formed in the longitudinal direction for the sake of the movement of the contents. At the bottom of the piston rod 500 is provided a spring support part 510 supporting the top of the first spring 700 for the piston rod 500 to ascend by means of an elastic force of the first spring 700.

In the present invention, at the top of the piston rod 500 is provided a spring engaging protrusion 520 which protrudes in the upward direction for the sake of the installation of the second spring 800. The spring engaging protrusion 520 serves to prevent the distortion of the second spring 800 and to guide the movements when the second spring 800 contracts and releases as the stem 400 descends and ascends.

Coming into contact with the support shoulder 410 of the stem 400, the spring engaging protrusion 520 helps generate a vacuum pressure in the interior of the stem 400 as much as the distance spaced apart from the support shoulder 410 when the stem 400 ascends by means of an elastic force of the second spring 800 for thereby sucking back the contents remaining at the end portion of the nozzle 910.

Surrounding the stem 400 and the piston rod 500, the sealing cap 600 is installed at the bottom of the stem 400.

In the present invention, the sealing cap 600 is made from an elastic material, the top of which is supported by the stem 400, the bottom of which is supported by the piston rod 500, so when the stem 400 descends, it is pressurized by the pressure of the stem 400 and then recovers for thereby allowing the stem 400 to ascend. A vacuum pressure is generated in the interior of the stem 400 as much as the length changed by a change in the length of the sealing cap 600 which occurs when the sealing cap 600 is compressed and recovers for thereby sucking back the contents remaining at the end portion of the nozzle 910.

The first spring 700 is installed in the interior of the cylinder 300, the bottom of which first spring is mounted at the spring mounting shoulder 330 formed at the bottom of the inner side of the cylinder 300, the other side of which is supported by the spring support part 510 of the piston rod 500 for thereby generating and transferring an elastic force to the piston rod 500 during the pumping operations.

The second spring 800 surrounds the spring engaging protrusion 520 of the piston rod 500, the bottom of which second spring is supported by the piston rod 500, the top of which is supported by the support shoulder 410 of the stem 400 for thereby providing an elastic force in the upward direction during pumping operation, so the stem 400 ascends.

In the present invention, the second spring 800 is contracted by the support shoulder 410 when the stem 400 descends by a pressure of the button 900 and recovers when the pressurization of the button 900 is removed for thereby allowing the stem 400 to ascend, so the support shoulder 410 of the stem 400 and the spring engaging protrusion 520 of the piston rod 500 becomes spaced apart. The stem 400 ascends by an elastic force of the second spring 800, and a vacuum space is generated in the interior of the stem 400 as much as the distance "H" defined as the support shoulder 410 and the spring engaging protrusion 520 are spaced apart for thereby sucking back the contents remaining at the end portion of the nozzle 910.

The button 900 is engaged to the top of the stem 400 and transfers a pressure to the stem 400 as a user pressurizes and has a nozzle 910 through which the contents moving through the stem 400 are discharged outside.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A dispenser for sucking back contents, comprising:

a body which is engaged to a top of a container body;

an engaging body which is engaged to the body and fixes a cylinder and is hollow;

the cylinder which is engaged to a bottom of the engaging body and has a content input hole formed at the bottom for inputting the contents and a valve member which is opened and closed by the pressure of the contents in the content input hole;

a stem which passes through the hollow interior of the engaging body and has a support shoulder at an inner surface;

a piston rod which is engaged to the stem, a bottom of which the piston rod is equipped with a spring support part, and a top which has a spring engaging protrusion which protrudes in an upward direction;

a sealing cap which is installed at a bottom of the stem, the outer surface of the sealing cap coming into close contact with an inner surface of the cylinder;

a first spring which is installed in the interior of the cylinder and serves to provide an elastic force to the piston rod;

a second spring which is installed surrounding the spring engaging protrusion of the piston rod, a bottom of which second spring is supported by the piston rod, and the top of which second spring is supported by the support shoulder of the stem for thereby providing an elastic force in an upward direction;

a button which is engaged to the top of the stem and has a nozzle for discharging the contents; and wherein the sealing cap is made from an elastic material and is contracted by a pressure of the stem when the stem descends and recovers.

* * * * *